US006590204B2

(12) United States Patent
Baranov

(10) Patent No.: US 6,590,204 B2
(45) Date of Patent: Jul. 8, 2003

(54) METHOD FOR REDUCING CHEMICAL BACKGROUND IN MASS SPECTRA

(75) Inventor: Vladimir Baranov, Richmond Hill (CA)

(73) Assignee: MDS Inc., Concord (CA)

( * ) Notice: Subject to any disclaimer, the term of this patent is extended or adjusted under 35 U.S.C. 154(b) by 200 days.

(21) Appl. No.: 09/845,766

(22) Filed: May 2, 2001

(65) Prior Publication Data

US 2002/0024009 A1 Feb. 28, 2002

(30) Foreign Application Priority Data

May 2, 2000 (CA) ..... 2307399

(51) Int. Cl.[7] ..... H01J 49/42
(52) U.S. Cl. ..... 250/282
(58) Field of Search ..... 250/282, 283, 250/292

(56) References Cited

U.S. PATENT DOCUMENTS 4,761,545 A 8/1988 Marshall et al.
4,945,234 A 7/1990 Goodman et al.
5,324,939 A 6/1994 Louris et al.
5,696,376 A * 12/1997 Doroshenko et al. ..... 250/292
5,703,358 A 12/1997 Hoekman et al.
6,124,591 A * 9/2000 Schwartz et al. ..... 250/282

OTHER PUBLICATIONS

Lee, Terrence A. et al., "Noise Reduction of Gas Chromatography/Mass Spectrometry Data Using Principal Component Analysis", Feb. 15, 1991, vol. 63, No. 4 Analytical Chemistry, pp. 357 to 360.

* cited by examiner

*Primary Examiner*—Jack Berman
*Assistant Examiner*—Johnnie L Smith, II
(74) *Attorney, Agent, or Firm*—Bereskin & Parr

(57) ABSTRACT

A computer-based method for reducing chemical background in acquired electrospray and nanospray mass spectra, which comprises the steps of pre-processing an acquired mass spectrum, transforming the pre-processed mass spectrum into the frequency domain, reducing peaks in the transformed mass spectrum at calculated frequencies, applying an inverse transformation to the mass spectrum represented in the frequency domain, further processing and subsequent output of a mass spectrum with chemical background reduced. The invention enables rapid, automated generation of mass spectra with the component attributed to chemical background reduced, thereby allowing the mass spectrum to be analyzed more easily and effectively. The invention also generates mass spectra with improved signal-to-noise ratio and sample mass accuracy.

14 Claims, 10 Drawing Sheets

METHOD FOR REDUCING CHEMICAL BACKGROUND IN MASS SPECTRA

FIELD OF THE INVENTION

This invention relates to a method for reducing chemical background in electrospray and nanospray mass spectra. More specifically, this invention relates to a computer-based method for reducing the component attributed to chemical background in acquired mass spectra.

BACKGROUND OF THE INVENTION

The mass spectrometer is an instrument that is used to establish the molecular weight and structure of organic compounds, and to identify and determine the components of inorganic substances. Presently, there are known a large number of different mass spectrometers, such as quadrupole, magnetic sector, Fourier transform ion cyclotron resonance (FTICR), and other multipole spectrometers and Time-of-Flight (TOF) devices. All of these, fundamentally, require sample molecules to be ionised. There are a variety of conventional techniques for converting an initially neutral sample into an ionized species in the gas phase. These ions are then separated in the mass spectrometer according to their mass/charge (m/z) ratios. For example, electrospray and nanospray techniques are particularly useful in mass spectrometry of macro molecular compounds. These ions are then typically detected electrically by the mass spectrometer, at which time the ion-currents corresponding to the different elements or compounds which comprise the sample can be measured. This information can then be stored, for example, in a computer for subsequent processing and analysis.

In mass spectrometry, it is well-known that many organic and inorganic samples may contain some quantity of undesirable compounds which are not the subject of study, but which were not removed in the process of preparing the samples for analysis. The undesirable compounds may also be contaminants that have found their way into the mass spectrometer during the sample introduction phase. These undesirable compounds subsequently produce chemical background in acquired mass spectra. For atmospheric pressure sources, the potential contaminants include gases.

The precise nature of chemical background is difficult to determine. Chemical background may be formed by all possible combinations of $(C_nA_m)^{+k}$, where C and A are cations and anions respectively, of different contaminant elements and compounds originating from the sample itself or from the sample introduction system, presented in combination n, m, and having charge k.

Various methods have been proposed in the art for removing these contaminants. The prior art system disclosed in U.S. Pat. No. 5,703,358 issued to Hoekman et al. contemplates a method for generating a filtered signal which can be applied in mass spectrometry experiments. The system disclosed in Hoekman et al. enables the rapid generation of filtered noise signals, (e.g., in real time during mass spectrometry experiments) without prior knowledge of the mass spectrum of unwanted ions to be ejected from an ion trap during application of the filtered noise signal to the ion trap. The system disclosed in Hoekman et al. does not appear to deal with the elimination of chemical background using spectrometry data already acquired.

The prior art method and apparatus disclosed in U.S. Pat. No. 5,324,939 issued to Louris et al. provides a method and apparatus for selectively ejecting a range of ions in an ion trap while retaining others. This method and apparatus does not appear to deal with the elimination of chemical background using spectrometry data already acquired.

The prior art method and apparatus disclosed in U.S. Pat. No. 4,761,545 issued to Marshall et al., provides a method and apparatus for excluding a range or ranges of ions from detection within an ion cyclotron resonance cell. This method and apparatus involves the ejection of unwanted ions from the cell, and does not appear to deal with the elimination of chemical background using spectrometry data already acquired.

These prior art systems and methods may succeed in eliminating contaminants with different mass/charge ratios, but they typically cannot remove contaminants having a mass/charge ratio similar to that of an ion of interest. Therefore, they cannot be used to filter out non-spectral interferences.

However, there is still a need to reduce or eliminate chemical background in post-experiment acquired mass spectra, so as to provide for a better signal-to-noise ratio, greater mass accuracy, and to improve the overall presentation of information relating to the sample, allowing for easier comprehension and analysis. More particularly, there is a need to filter out non-spectral interferences covering a wide range of mass/charge ratios.

There is also a need for a rapid, efficient, and automated process for reducing or eliminating chemical background from a given mass spectrum. Further, there is a need for a method which can process data already obtained from a mass spectrometer without having to perform additional experiments using the mass spectrometer or to make subsequent adjustments to the mass spectrometer, to obtain a mass spectrum with reduced chemical background.

There is also a need for reducing or eliminating chemical background in real-time, as data is being acquired from a mass spectrometer or shortly thereafter.

SUMMARY OF THE INVENTION

The invention provides for a method of reducing chemical background from a mass spectrum comprising the steps of obtaining a mass spectrum including both data for desired ions of interest and a chemical background, determining the presence of chemical background in the mass spectrum and determining at least one dominant frequency of the chemical background, and filtering out at least one dominant frequency whereby at least a substantial portion of the chemical background is removed from the mass spectrum.

BRIEF DESCRIPTION OF THE DRAWINGS

For a better understanding of the present invention, and to show more clearly how it may be carried into effect, reference will now be made, by way of example, to the accompanying drawings which show a preferred embodiment of the present invention, and in which.

DESCRIPTION OF THE PREFERRED EMBODIMENT

Figure 1:
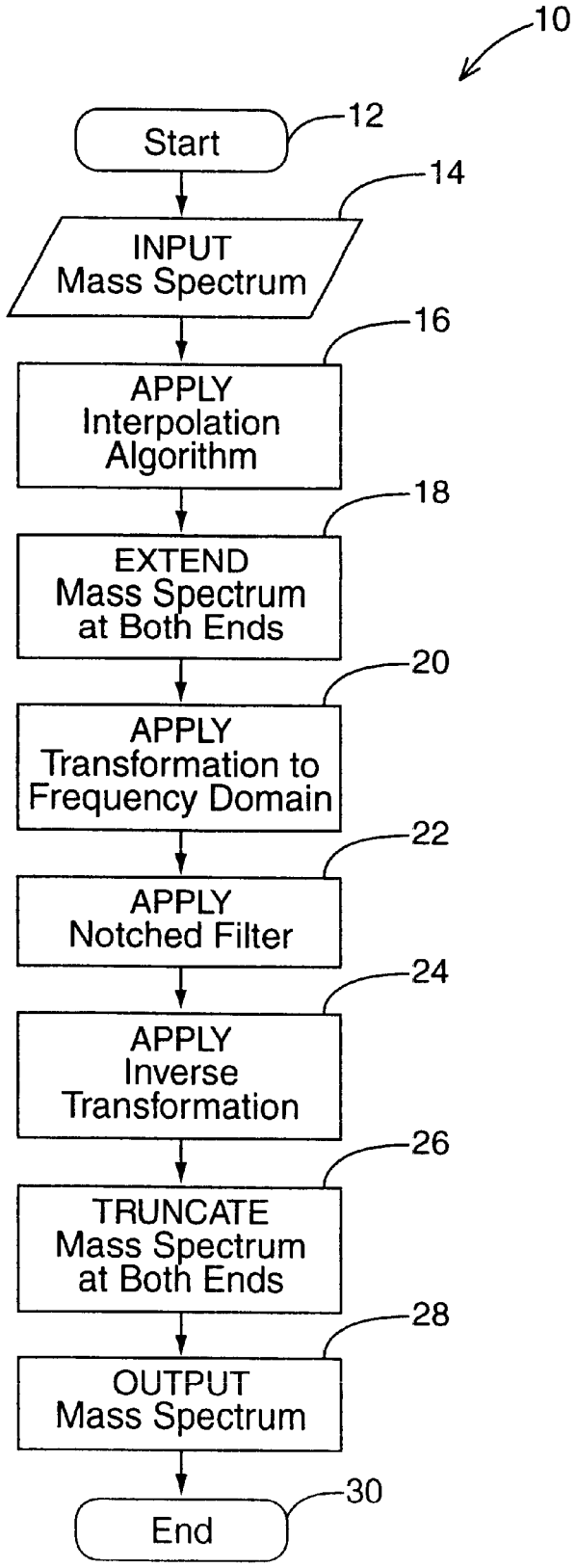
FIG. 1 is a flow chart diagram illustrating the method steps performed by the present invention.

Referring to FIG. 1, a method for reducing chemical background 10 commences at step 12. At step 14, information pertaining to a mass spectrum (such as that shown in FIG. 3) is entered as input to a computer program which implements the method for reducing chemical background 10. The input mass spectrum obtained at step 14 comprises data acquired from a mass spectrometer, where ion signal intensity (in counts per second, for example) at different mass/charge (m/z) ratios is measured. Accordingly, a graph of the input mass spectrum may comprise a plot of the intensity of the ion signal (vertical axis) against values of mass/charge (horizontal axis). However, if the input mass spectrum represents data obtained by a time-of-flight mass spectrometer, a graph of the input mass spectrum may instead, and in known manner, comprise a plot of the intensity of the ion signal (vertical axis) against the arrival time of ions at a detector, where the detector is usually divided into acquisition bins (vertical axis).

The input mass spectrum obtained at step 14 often comprises a signal which is periodic, with a period close to one atomic mass unit (amu), and which has an amplitude that decays uniformly with mass. Further, it has been observed that if the resolution of the mass spectrometer is significantly better than one atomic mass unit (e.g. in the case of a time-of-flight (TOF) mass spectrometer or a Fourier transform ion cyclotron resonance (FTICR) mass spectrometer), the chemical background has a lower resolution than the resolution of a useful signal. The amplitude of the signal in the mass spectrum corresponding to chemical background will not necessarily be lower than the amplitude of the peaks corresponding to a useful sample signal. In any event, it has been found that the characteristic appearance frequency of chemical background is different from the useful sample signal in the mass spectrum. The present invention is based on the realization that this difference in frequency characteristics between chemical background and the useful sample signal can be used to reduce chemical background.

The method for reducing chemical background 10 can be performed on an input mass spectrum obtained at step 14, where data comprising the input mass spectrum is acquired immediately from a mass spectrometer as soon as it is available. Thus the method for reducing chemical background 10 may be considered to be performed on an input mass spectrum in "real-time".

A first pre-processing step at step 16 is to be performed if the input mass spectrum obtained at step 14 has been acquired using a TOF mass spectrometer. Points on a mass spectrum directly acquired from a TOF mass spectrometer are equally spaced in time according to the arrival of ions to acquisition bins of a detector assembly, and there is a non-linear relationship between the arrival times and the mass/charge ratio of ions. Prior to any further processing of the input mass spectrum, it may be desirable to obtain a mass spectrum that is equally spaced on the mass/charge ratio scale. Therefore, at step 16, an interpolation algorithm can be applied to the mass spectrum to achieve this result. In the preferred embodiment of the invention, a cubic spline interpolation algorithm over an equidistant mass/charge mesh can be used. The size of the mesh is required to be small to preserve the resolution of the mass spectrum. This results in the generation of a modified mass spectrum after the interpolation algorithm is applied at step 16 to the input mass spectrum originally obtained at step 14.

For a linear mass/charge scale, or other scale, on the horizontal axis, this scale can be treated or analogized to a time scale. Then, the chemical background can be considered to have a "frequency" and can be transformed into the frequency domain for analysis in known manner. Put another way, the appearance frequency of the peaks in chemical background is with respect to the mass/charge ratio (or other scale). The concept of "frequency" is used in this manner throughout this specification in the claims.

Strictly, for TOF mass spectrometry data, it is always required to convert the equally time-spaced data into the equally mass/charge-spaced mass spectrum. However, when a TOF mass spectrum is divided into very small fragments (several mass/charge units), the difference between converted and non-converted spectra is very small.

In a variant embodiment of the invention, step 16 is omitted and no interpolation algorithm is applied to the input mass spectrum obtained at step 14. The flow of method steps proceeds directly to step 18. For instance, this is the case where a quadrupole mass spectrometer is used.

In another variant embodiment of the invention, a different interpolation algorithm may be applied in the same manner as the cubic spline interpolation algorithm was applied to the input mass spectrum at step 16 in the preferred embodiment of the invention. Other interpolation algorithms may include: a linear interpolation algorithm, a quadratic spline interpolation algorithm, a spline interpolation algorithm of a degree higher than the cubic or quadratic case, or any other suitable interpolation algorithm as is conventionally known.

The modified mass spectrum obtained at step 16 is then further pre-processed at step 18. At step 18, further preparations are effected of the input mass spectrum obtained at step 14 and subsequently modified at step 16, for the transformation that is to occur in subsequent steps of the method for reducing chemical background 10. The method for reducing chemical background 10 will not work well on the ends of the mass spectrum in absence of the performance of step 18. This may be attributed to what is conventionally known as the Nyquist problem.

At step 18, to deal with the Nyquist problem, signals represented as waveforms in the time domain that are to be transformed and subsequently represented in the frequency domain, should be sampled at a rate greater than twice the highest signal frequency in the waveform when applying a transformation. Further, to increase accuracy at the ends of the spectrum, additional points (e.g. corresponding to 5–15% of the length of the input mass spectrum obtained at step 14) are added to the low mass/charge side of the modified mass spectrum generated at step 16 or the low mass/charge side of the input mass spectrum obtained at step 14 if step 16 was not performed) which are set equal to a pre-determined value. Similarly, additional points are added to the high mass/charge side of the modified mass spectrum generated at step 16 (or the high mass/charge side of the input mass spectrum obtained at step 14 if step 16 was not performed), with each point being set equal to a pre-determined value.

There are numerous approaches to choosing the pre-determined value which will be assigned to the additional points added to the ends of the modified mass spectrum at step 18. In the preferred embodiment of the invention, the additional points added to the low and high mass/charge sides of the modified mass spectrum are set to a value equal to the mean value of several hundred points which occur at the respective ends of the modified mass spectrum. This prevents the constant signal component underlying the input mass spectrum from being artificially changed. In a variant embodiment of the invention, the additional points added to the low and high mass/charge sides of the modified mass spectrum are set to zero. Adding zero values may be less computationally intensive than calculating the mean value of the points at the end of the modified mass spectrum, but this tends to introduce an additional undesired constant signal component in the mass spectrum being processed.

In another variant embodiment of the invention, one can add additional points to the low and high mass/charge ends of the modified mass spectrum generated at step 16 (or the input mass spectrum obtained at step 18 when step 16 is not performed), to generate an extended mass spectrum containing a number of points equal to $2^n$, such that n is an integer (e.g. $2^{20}$=1048576 points). This approach permits the application of a Fast Fourier Transformation (FFT) with an input vector of length having a power of 2, to be applied in subsequent steps in the method for reducing chemical background 10.

In step 20, the extended mass spectrum generated at step 18, is processed in the method for reducing chemical background 10. At step 20, the extended mass spectrum is subject to a Fourier Transformation. Step 20 generates a transformed mass spectrum in the frequency domain, where distinct peaks can be observed at certain frequencies, where these frequencies may be referred to as "dominant frequencies" in the transformed mass spectrum. As the signal corresponding to the chemical background in the input mass spectrum obtained at step 14 is periodic (with a period of approximately one atomic mass unit), the dominant frequencies in the transformed mass spectrum generated at step 20 can be attributed mainly to chemical background. The positions of the dominant frequencies are readily determined from the size of the data set and the corresponding mass range. Specifically the base frequency can be determined by dividing the length of the extended mass spectrum (e.g. in units of acquisition bins in TOF mass spectrometry data) by the total number of masses corresponding to the length of the extended mass spectrum. Other dominant frequencies will occur in multiple harmonics of the base frequency.

Subsequently at step 22, the dominant frequencies in the transformed mass spectrum of step 20 may be reduced or eliminated by applying a notched filter to the transformed mass spectrum of step 20. At selected frequency intervals, notches are provided reducing the value of the signal by a pre-determined factor within the frequency interval. At all other frequencies, the notched filter does not affect the signal being filtered. For instance, a notched filter can be applied to a transformed mass spectrum to generate a filtered mass spectrum by reducing the values of the signal represented in the transformed mass spectrum to zero within intervals of a pre-specified width centered at the dominant frequencies. Graphically, the notched filter can be illustrated as a function comprised of a series of rectangular troughs of a set depth below unity (as in FIG. 2*a*) and of a pre-specified width centered at the dominant frequency, and superimposed on a unit function. The filtered mass spectrum is obtained by multiplying the value of the signal in the transformed mass spectrum at each frequency in the transformed mass spectrum (or samples therefrom) by the corresponding value of the function representing the notched filter at that frequency. The width of each filtering component can be manually set by an operator, or predetermined and applied automatically at step 22.

Figure 2A:
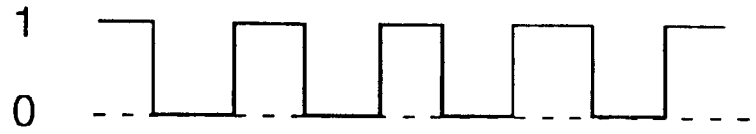
FIGS. 2*a* and 2*b* are illustrations of functions representing alternative notched filters.
Figure 7:
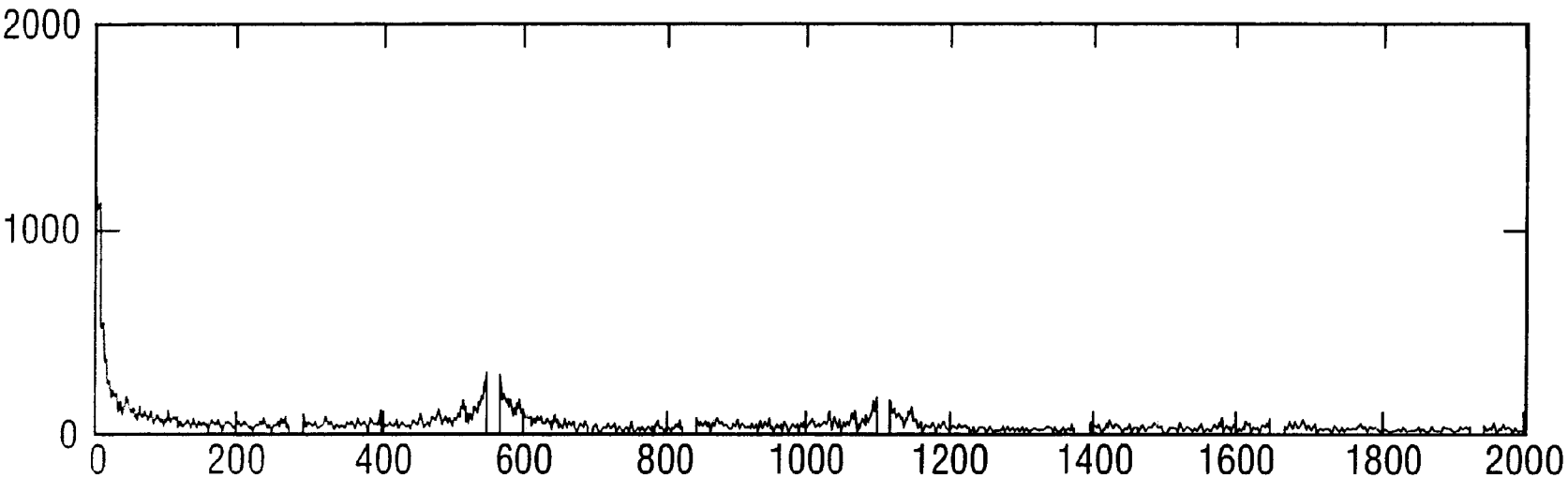
FIG. 7 illustrates a filtered mass spectrum obtained after the filter of FIG. 6 is applied to the transformed mass spectrum of FIG. 5.

FIG. 2*a* shows simple rectangular notches, and as will be explained below in reference to FIG. 7, this can lead to a distinct "notched" or discontinuous effect in a filtered mass spectrum.

Figure 2B:
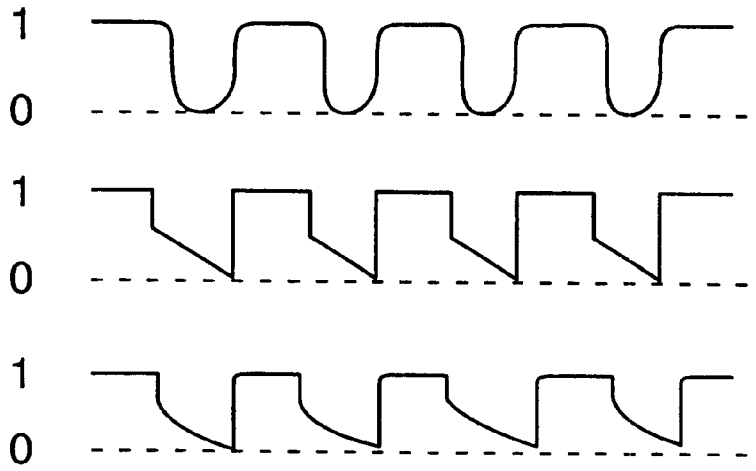

Referring to FIG. 2*b*, functions representing alternative notched filters with varying trough shapes that may be applied at step 22 in other embodiments of the invention, are illustrated. Applying one of these alternative notched filters will produce different filtered mass spectra, and may be more effective in reducing chemical background in different input mass spectra. Thus, a desired notch shape or profile is selected empirically, to provide the optimum filtering effect for a particular chemical background.

It may be beneficial to interpolate smoothly between the frequencies unaffected by the chemical background at the points which would be reduced in value upon application of a rectangular notched filter at step 22, that is, effectively to round the corners of the notch.

At step 24, the filtered mass spectrum generated at step 22 is subject to an inverse Fourier Transformation to generate an inverse-transformed mass spectrum representing signal intensity over a range of mass/charge ratios. The inverse-transformed mass spectrum obtained at step 24 has substantially reduced chemical background.

In the preferred embodiment to the invention, a Fourier Transformation was applied at step 20 and an inverse Fourier Transformation was applied at step 24. However, in other embodiments of the invention, other transformations into the frequency domain may also be applied. For example, a Hartley Transform which restricts all operations to the domain of real numbers, may be used at step 20 with the inverse transformation applied at step 24. Sine and cosine transforms and their inverses may also be used at step 20 and step 24 respectively. Alternatively, a Walsh Transform or a Hilbert Transform and their inverses can be used in step 20 and 24 respectively. A further alternative is to use a representation of a mass spectrum in the frequency domain obtained by using wavelets, wavelet packets and local cosine packets multi-resolution analysis, which provide a framework in which separation of different frequencies of a signal can be used to eliminate components related to chemical background. Further, time-frequency analysis concerned with how the frequency content of a signal changes with time may also be employed.

At step 26, the inverse-transformed mass spectrum obtained at step 24 is truncated at both ends by removing the points, which may or may not have changed in value, that were added to the low and high mass/charge ends of the modified mass spectrum at step 18. This results in an output mass spectrum having a length equal to the length of the input mass spectrum originally obtained at step 14. The output mass spectrum generated at step 26 has a reduced chemical background, and is subsequently produced as output at step 28. Step 30 marks the end of the method for reducing chemical background 10.

In a variant embodiment of the invention, the input mass spectrum obtained at step 14 may be obtained from an FTICR mass spectrometer, where the original data acquisition occurs in the frequency domain. In this case, the present invention can be applied to the input mass spectrum by directly employing step 22 (application of the notched filter) to the input mass spectrum obtained at step 14. Steps 16, 18 and 20 are then omitted.

In another variant embodiment of the invention, an additional step can be employed after step 22 in which any existing peak at the low frequency end of the transformed mass spectrum can be reduced in height or removed prior to the inverse transformation at step 24. This tends to have the effect of reducing the constant component that underlies the input mass spectrum obtained at step 14, and subsequently produces an output mass spectrum that is flatter, allowing the output mass spectrum to be more easily read.

Figure 3:
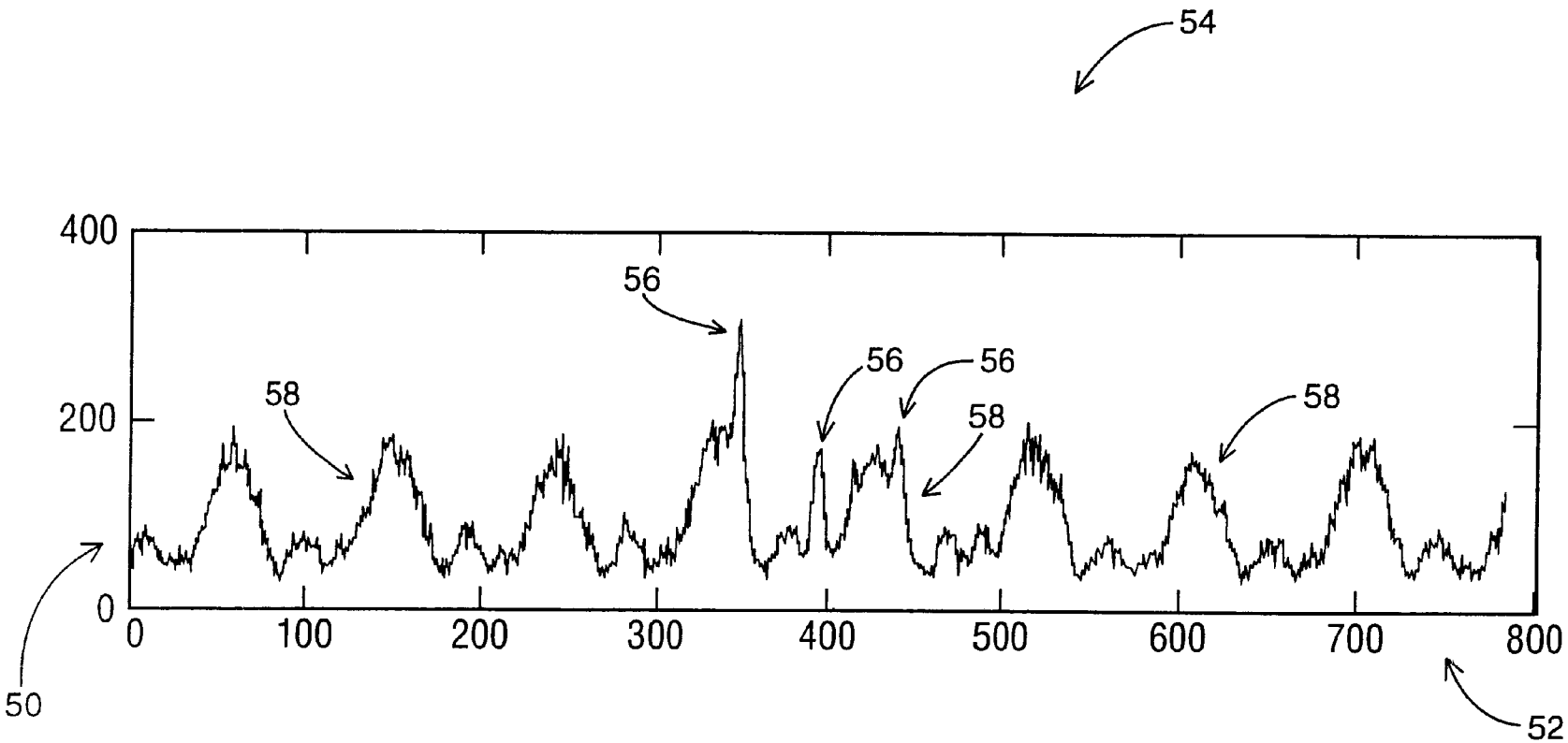
FIG. 3 is a graph of a typical input mass spectrum.

An example of an input mass spectrum obtained at step 14 of FIG. 1 is illustrated in FIG. 3. Referring to FIG. 3, the vertical axis 50 represents signal intensity, while the horizontal axis 52 represents acquisition bin numbers, which are proportional to the acquisition time of ions at acquisition bins in an orthogonal TOF mass spectrometer. Input mass spectrum 54 is comprised of a desired sample signal 56, and chemical background 58. It is evident that determining the level of the sample signal 56 is hindered by chemical background 58. The signal-to-noise ratio and mass accuracy of the sample signal 56 are clearly compromised.

Figure 4A:
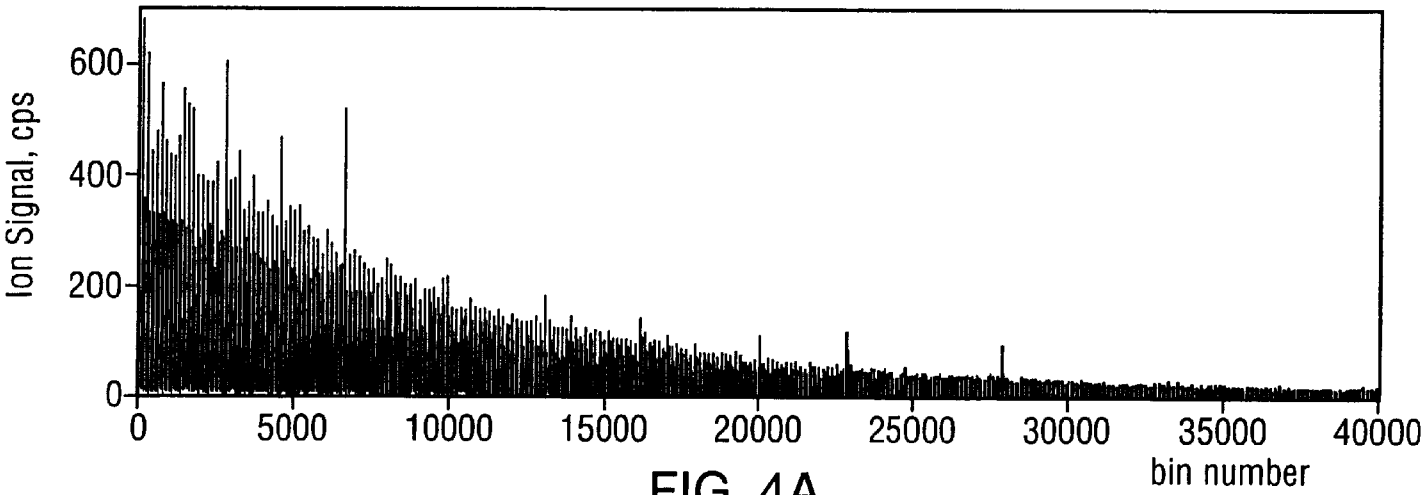
FIG. 4*a* is a graph illustrating a first example input mass spectrum.

A first example of an application of the present invention is illustrated in FIGS. 4*a* to 8*c* that accompany this disclosure. FIG. 4*a* is an input mass spectrum that would be obtained at step 14 of FIG. 1 of the method for reducing chemical background 10 of FIG. 1. The vertical axis 60 represents signal intensity, while the horizontal axis 61 represents acquisition bin numbers 62. The mass/charge ratio is a non-linear function of the acquisition bin numbers 62, which is proportional to the acquisition time. Thus a mass/charge scale on the horizontal axis can be imposed on the input mass spectrum of FIG. 4*a*.

Figure 4B:
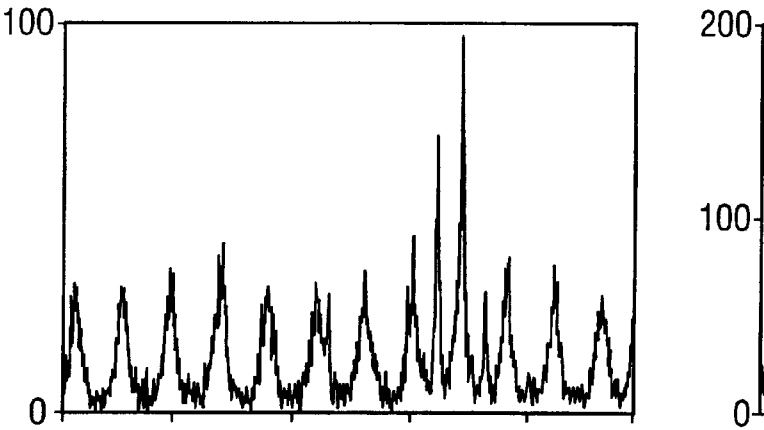
FIGS. 4*b* and 4*c* are graphs illustrating magnified sections of the first example input mass spectrum of FIG. 4*a;*
Figure 4C:
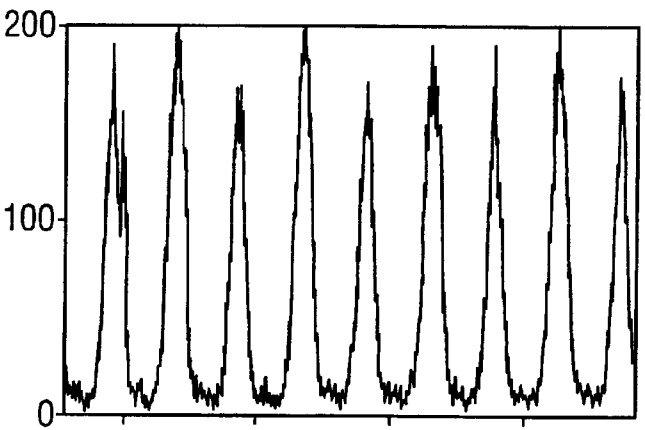

Referring to FIGS. 4*b* and 4*c*, magnified portions of the input mass spectrum of FIG. 4*a* are shown. Clearly, the presence of chemical background again hinders the identification of the sample signal. Also, again as in FIG. 3, the chemical background is periodic in nature. It can be noted that the mass/charge ranges in FIGS. 4*b* and 4*c* are so small that the non-linearity between bin numbers and mass/charge ratios is not apparent.

Figure 5:
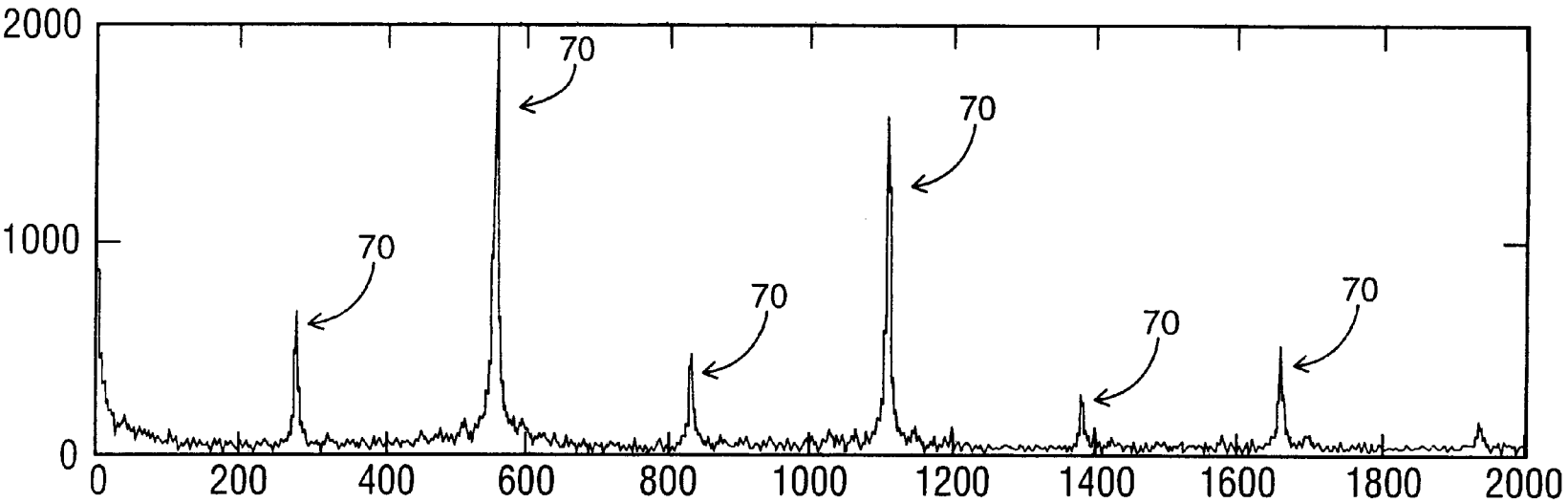
FIG. 5 is a graph illustrating a transformed mass spectrum obtained from the first example input mass spectrum of FIG. 4*a* after pre-processing and a Fourier transformation.

Referring to FIG. 5, the transformed mass spectrum obtained after the pre-processing steps of step 16 and step 18 of FIG. 1 and the Fourier Transformation step 20 of FIG. 1 are applied, is shown. Dominant frequencies 70 can be observed, which correspond to the base frequency of chemical background, and harmonics of the base frequency. As noted above, while the signal of interest at a particular mass/charge ratio may be dominant, it is clear that, overall, the bulk of the signal in the transformed mass spectrum is chemical background, and commonly the spectral intensity of the chemical background, as a whole, will be several orders of magnitude above signal(s) of interest. Thus, once can safely assume that the dominant frequencies are chemical background. Furthermore, since the signal of interest is not typically periodic, corresponding frequencies are distributed across the entire frequency range. This ensures that after removal of the dominant frequencies attributed to chemical background, damage to the signal of interest will be minimal.

Figure 6:
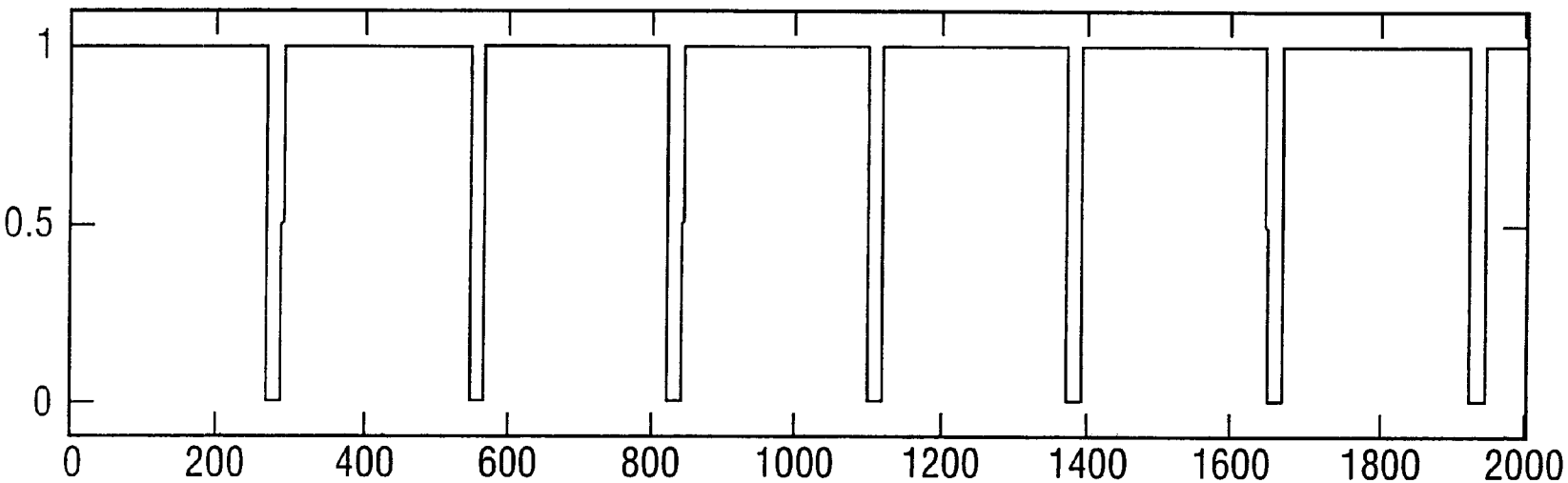
FIG. 6 is a graph illustrating a notched filter to be applied to the transformed mass spectrum of FIG. 5.
Figure 8A:
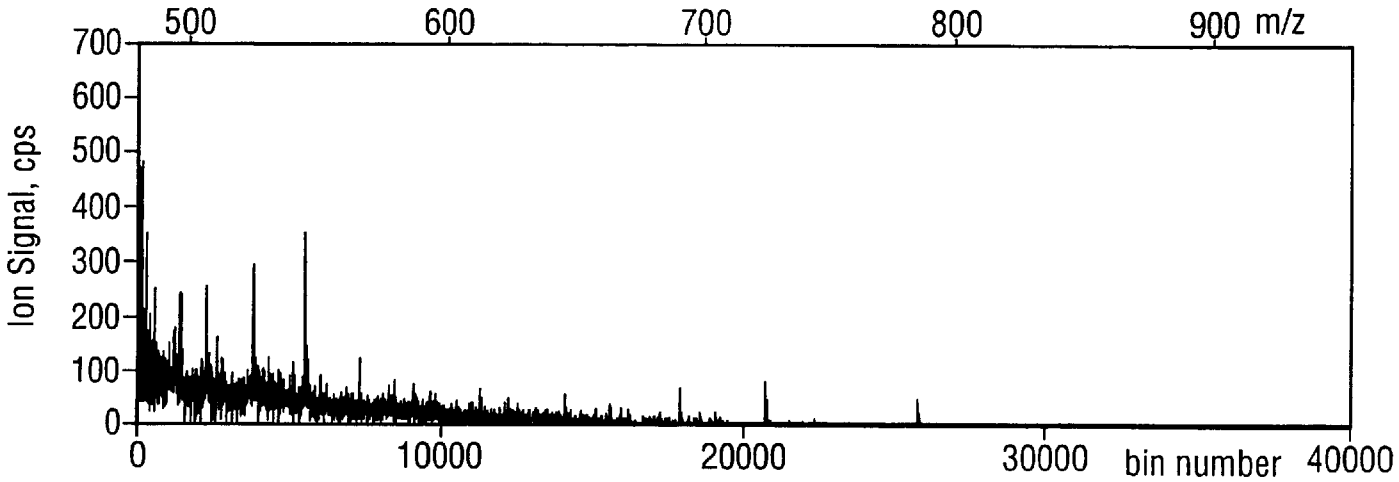
FIG. 8*a* is a graph illustrating a mass spectrum obtained after an inverse Fourier transform is applied to the filtered mass spectrum of FIG. 7.
Figure 8B:
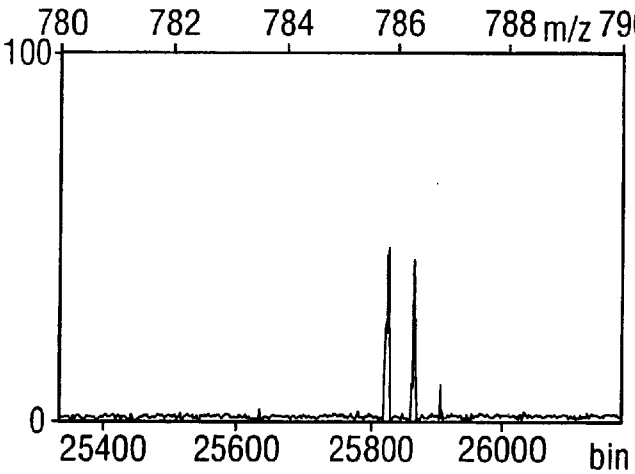
FIGS. 8*b* and 8*c* are magnified sections of the filtered mass spectrum of FIG. 8*a;*
Figure 8C:
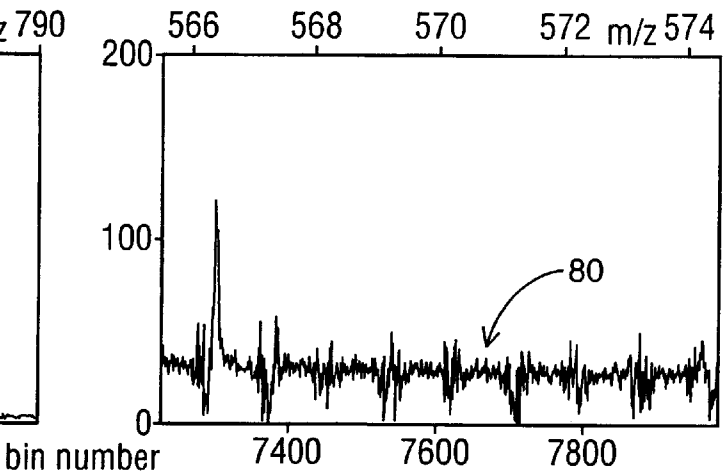

Referring to FIG. 6, a rectangular-troughed notch filter is illustrated, which has been selected to have notches corresponding to the peaks of FIG. 5. The notched filter of FIG. 6 is applied at step 22 of FIG. 1 to the transformed mass spectrum of FIG. 5, to obtain the filtered mass spectrum of FIG. 7. This clearly shows removal of the peaks representing chemical background, and removal of a significant portion of the overall spectrum originating from the chemical background. As noted above, the use of sharp-edged notches is apparent in the filtered mass spectrum of FIG. 7; more rounded notches would give the effect in FIG. 7 of a more continuous, or less "notched", spectrum. An inverse Fourier Transformation algorithm as applied at step 24 of FIG. 1 is applied to the filtered mass spectrum of FIG. 7 to obtain an inverse-transformed mass spectrum, which is then truncated at step 26 of FIG. 1 to obtain an output mass spectrum as shown in FIG. 8*a*. FIGS. 8*b* and 8*c* are magnified sections of the output mass spectrum shown in FIG. 8*a*. The output mass spectrum of FIG. 8*a* illustrates the application of the invention to the input mass spectrum of FIG. 4*a*. Reducing chemical background results in the output mass spectrum being easier to read. Peaks of a sample mass signal now appear in their proper relative magnitudes, as can be observed in comparing FIG. 4*b* (section of input mass spectrum) and FIG. 8*b* (section of output mass spectrum). Peaks corresponding to a sample mass signal which could not clearly be identified in the presence of chemical background in the input mass spectrum, are now clearly identifiable as can be observed in comparing FIG. 4*c* (section of input mass spectrum) and FIG. 8*c* (section of output mass spectrum).

Residual background noise 80 may appear as a result of the application of the rectangular-troughed notched filter at step 22 of FIG. 1. The residual background noise 80 may be reduced by applying a different notched filter with smoother-edged troughs as shown in FIG. 2*b*, or alternatively interpolating between frequencies unaffected by chemical background at the points which would be reduced in value upon application of a rectangular-troughed notched filter at step 22 of FIG. 1.

Figure 9A:
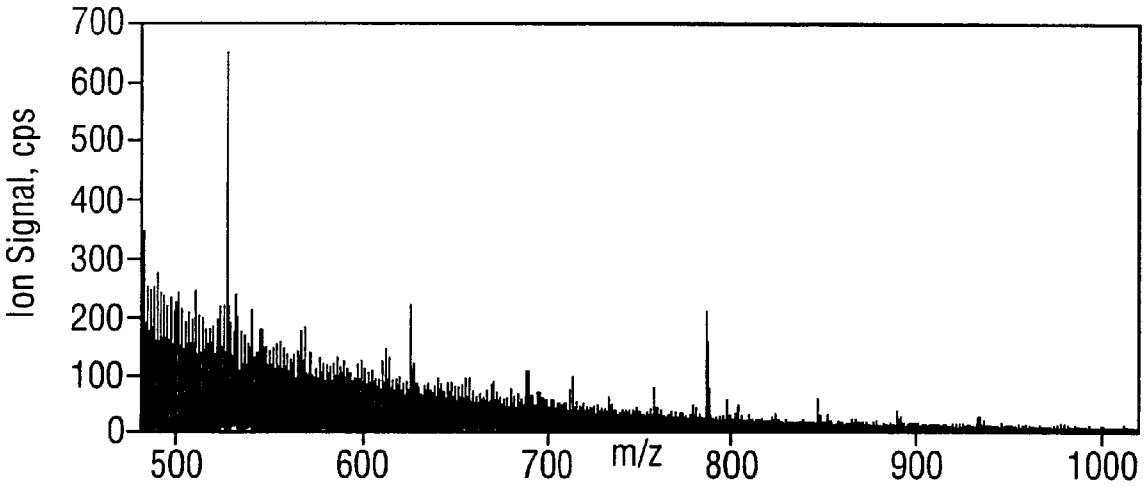
FIGS. 9*a*, 9*b* and 9*c* are graphs illustrating a second example input mass spectrum and magnified sections thereof.
Figure 9C:
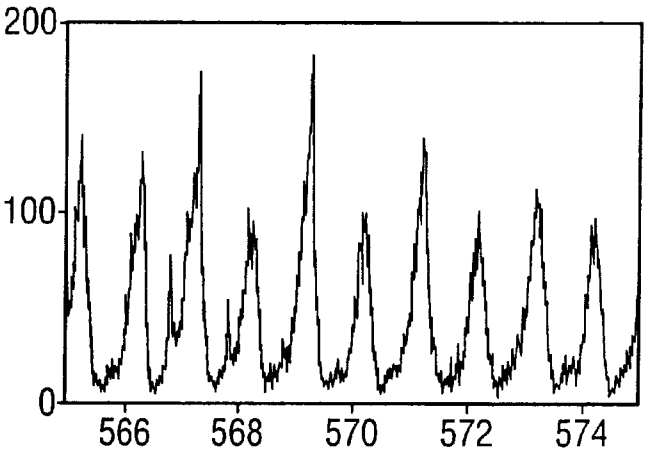
Figure 9B:
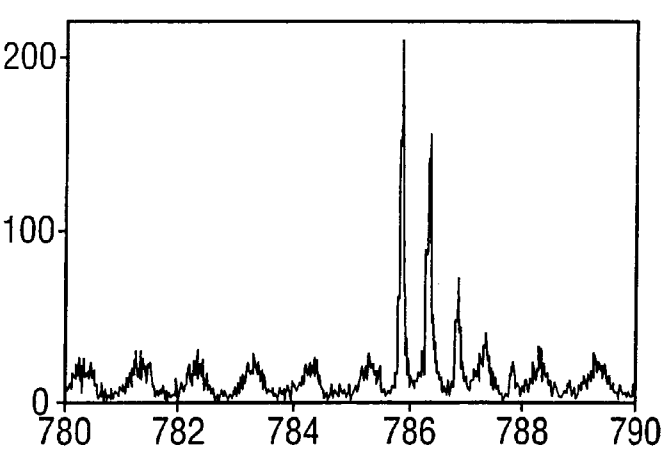
Figure 10A:
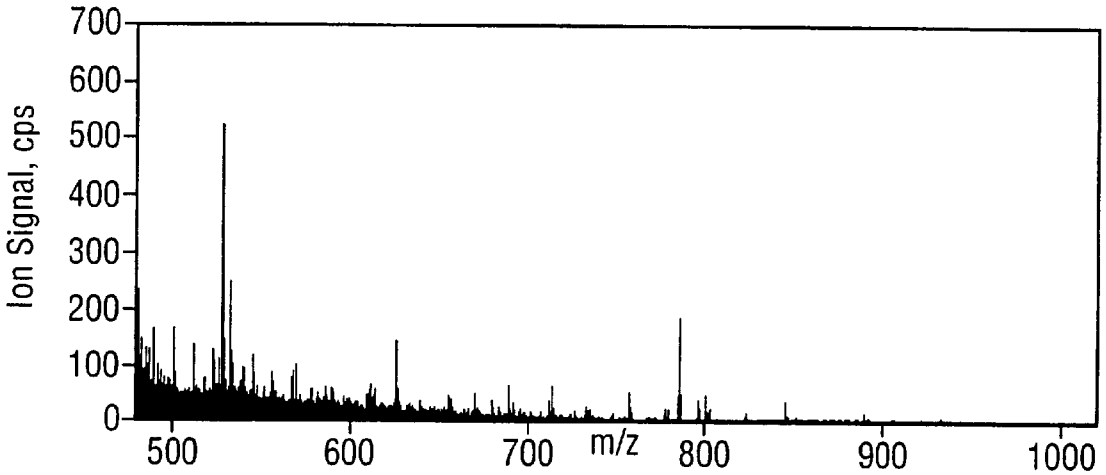
FIGS. 10*a*, 10*b* and 10*c* are graphs illustrating the mass spectrum obtained after the method of the present invention is applied to the second example input mass spectrum of FIG. 9*a*, and magnified sections thereof.
Figure 10C:
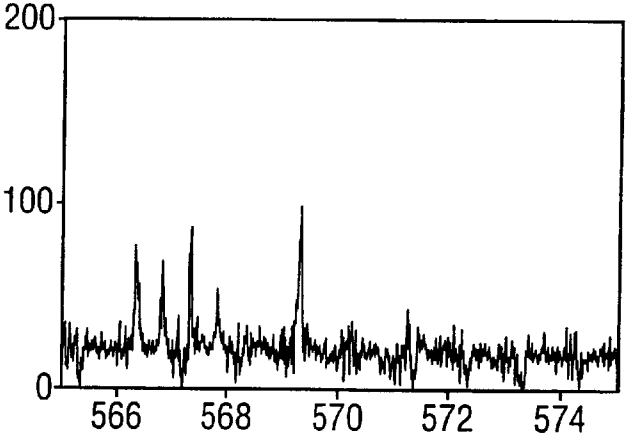
Figure 10B:
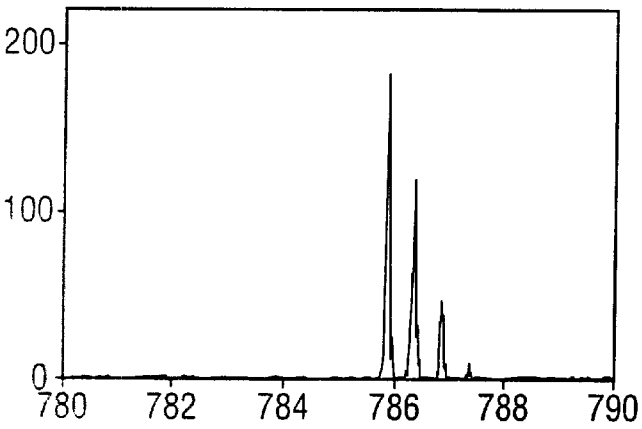

The results of a second example of an application of the present invention are illustrated in FIGS. 9*a*, 9*b* and 9*c* which correspond to an input mass spectrum, and in FIGS. 10*a*, 10*b* and 10*c* which correspond to an output mass spectrum where chemical background is reduced.

As will be apparent to those skilled in the art, various modifications and adaptations of the methods described herein are possible without departing from the present invention, the scope of which is defined in the claims.

I claim:

1. A method of reducing chemical background from a mass spectrum, the method comprising:

(i) obtaining a mass spectrum including both data for desired ions of interest and a chemical background;

(ii) determining the presence of chemical background in the mass spectrum and determining at least one dominant frequency of the chemical background; and (iii) filtering out at least one dominant frequency of the chemical background whereby at least a substantial portion of the chemical background is removed from the mass spectrum.

2. The method as claimed in claim 1, which includes, prior to step (ii), effecting a transformation of the mass spectrum into the frequency domain and identifying a plurality of dominant frequencies of the chemical background in the frequency domain, removing the identified dominant frequencies of the chemical background in the frequency domain, and effecting an inverse transformation, to generate a filtered mass spectrum.

3. The method as claimed in claim 2, which includes first acquiring a mass spectrum from a mass spectrometer device and effecting the method in real time immediately after acquisition of the mass spectrum.

4. The method as claimed in claim 1, 2, or 3 which comprises providing the spectrum as a set of digital data and effecting the method on a computer.

5. The method as claimed in claim 2, wherein step (i) comprises providing a mass spectrum which is non-linear with respect to mass/charge ratio, and wherein the method includes effecting an interpolation algorithm to convert the mass spectrum to a linear mass spectrum with respect to mass/charge ratio.

6. The method as claimed in claim 5, which includes effecting the interpolation algorithm using cubic spline interpretation over an equidistant mass/charge mesh.

7. The method as claimed in claim 2, wherein the transformation step and the inverse transformation step comprise, respectfully, effecting a Fourier transformation and effecting an inverse Fourier transformation.

8. The method as claimed in claim 2, wherein the transformation step comprises effecting a transform selected from the group comprising:

a Hartley transform;

a sine transform;

a cosine transform;

a Walsh transform; and a Hilbert transform; and wherein the inverse transformation comprises effecting the inverse of the selected transformation technique.

9. The method as claimed in claim 2, which comprises effecting step (iii) with a filter comprising a notched filter, applied to the transformed mass spectrum, the mass spectrum being multiplied by the notched filter in the frequency domain and the notched filter including, at the dominant frequencies of the chemical background, notches which at least significantly reduces the magnitude of the dominant frequencies.

10. The method as claimed in claim 9, wherein the notched filter includes rectangular notches.

11. The method as claimed in claim 9, wherein the notched filter includes notches having a shaped selected to optimize removal of the chemical background while not impairing signals of interest.

12. The method as claimed in claim 2, which includes: a pre-processing step comprising extending the mass spectrum to mass/charge ratios less than and greater than mass/charge ratios encompassed by the mass spectrum, prior to transforming the mass spectrum in the frequency domain; and after effecting inverse transformation to recreate the mass spectrum, effecting a post transformation step to truncate the mass spectrum to remove undesired mass/charge ratios not present in the original mass spectrum.

13. The method as claimed in claim 12, which includes providing an original mass spectrum extending between a first low mass/charge ratio and a second high mass/charge ratio, and wherein the post-transformation step comprises removing data for mass/charge ratios below the first, low mass/charge ratio and data for mass/charge ratios above the second, high mass/charge ratio.

14. The method as claimed in claim 1, which includes in step (i), obtaining mass spectrum data from a mass spectrometer that generates data in the frequency domain, the method including identifying dominant frequencies of the chemical background, removing the identified dominant frequencies of the chemical background in the frequency domain, and effecting an inverse transformation, to generate a filtered mass spectrum.

* * * * *